United States Patent [19]

Hofer

[11] Patent Number: 4,894,113

[45] Date of Patent: Jan. 16, 1990

[54] APPARATUS FOR MANUFACTURING A CORRUGATED MEMBER

[76] Inventor: Otto J. Hofer, Im Gafos 8, 9494 Schaan, Liechtenstein

[21] Appl. No.: 211,088

[22] Filed: Jun. 21, 1988

Related U.S. Application Data

[63] Continuation of Ser. No. 6,329, Jan. 14, 1987, abandoned, which is a continuation of Ser. No. 456,445, Jan. 17, 1983, abandoned.

[30] Foreign Application Priority Data

Jan. 13, 1982 [CH] Switzerland ..... 175/82

[51] Int. Cl.[4] ..... B31F 1/20

[52] U.S. Cl. ..... 156/462; 156/469; 156/471

[58] Field of Search ..... 156/72, 183, 204, 205, 156/206, 210, 290–292, 462, 469, 470, 471, 285, 468, 474, 553, 538; 264/286; 493/463; 425/369, 396; 428/179; 112/25, 132, 133

[56] References Cited

U.S. PATENT DOCUMENTS

| | | | |
|---|---|---|---|
| 3,402,092 | 9/1968 | Wiesinger | 156/538 X |
| 3,685,931 | 8/1972 | Craven et al. | 425/396 X |
| 4,093,483 | 6/1978 | Jacobs | 156/474 X |
| 4,288,278 | 9/1981 | Akao | 156/474 |

FOREIGN PATENT DOCUMENTS

| | | |
|---|---|---|
| 0494407 | 3/1930 | Fed. Rep. of Germany . |
| 0263453 | 12/1949 | Switzerland . |

OTHER PUBLICATIONS

Merhar, G., "A Contribution to the Form of Design Catalogues in the Field of Mechanisms", Dissertation 6698, ETH, Zurich, 1981.

*Primary Examiner*—Raymond Hoch

*Attorney, Agent, or Firm*—Shoemaker and Mattare, Ltd.

[57] ABSTRACT

A corrugated member comprising a top web (2) and a carrier web (3) is manufactured by stepwise forward feed movement of the carrier web, with simultaneous deformation of the top web and joining of the two webs. At a shaping station (1), a deformation element (6) is first introduced between the top web (2) and the carrier web (3), and the top web is pressed against the carrier web by a first pressing means (4), downstream of the deformation element. Then, upstream of the deformation element (6), the top web (2) is pressed against the deformation element by a second pressing means (5), stretched over the deformation element, and joined to the carrier web (3).

13 Claims, 6 Drawing Sheets

APPARATUS FOR MANUFACTURING A CORRUGATED MEMBER

This is a continuation of application Ser. No. 006,329 filed Jan. 14, 1987, now abandoned which is a continuation of application Ser. No. 456,445 filed Jan. 7, 1983, now abandoned.

FIELD OF THE INVENTION

This invention relates to methods of and apparatus for manufacturing corrugated members.

BACKGROUND

Methods and apparatuses for manufacturing corrugated members are generally known and conventional. As disclosed for example in German patent No. 494,407 or Swiss patent No. 263,453, a top web, in particular comprising stiff paper or cardboard, is put into a corrugated configuration and then joined to a carrier or backing web. In that situation the top web may be shaped as desired, and in accordance with the shape of the material to be packaged. The top web and the backing web are joined together by an adhesive which is applied to the carrier web directly before the top web is applied thereto. Generally, corrugated members of that kind are produced by the top web being continuously deformed. Adhesive is then applied and the carrier web is then pressed against the top web, which is shaped continuously or discontinuously, and then wound under stress on to rollers, together with the top web, for the adhesive to dry.

The known methods suffer from various disadvantages, in particular that the corrugated shape of a corrugated member cannot be easily altered, and there is no possibility of a reasonable continuous manufacturing process. In particular, dividing the method into individual steps, namely deformation of the top web, then bringing the top web together with the carrier web, the separate application of adhesive, the drying step, and then cutting the web assembly to the desired length, make it difficult to effect rational manufacture.

The problem or object of the present invention is to avoid the disadvantages of the known art and in particular therefore to provide a method and an apparatus for manufacturing a corrugated member, wherein the steps of the method are simplified and minimized, the manufacturing process generally is shortened, while nonetheless corrugated members of any desired surface configuration can be produced.

FEATURES AND ASPECTS OF THE INVENTION

According to the invention, this problem is primarily solved by a method which is characterized in that the carrier web is moved forward with a stepping motion relative to a shaping station, that in operation the top web which is to be connected to the carrier web is supplied by a feed means, that after each feed step the top web is pressed both against at least one deformation element, which is introduced between the carrier web and the top web, and against the carrier web, and thus deformed and at the same time connected to the carrier web, and that the length of a feed step is such that it corresponds at least to the spacing of two successive connecting locations.

In accordance with the invention therefore, the operation of deforming the top web coincides with the operations of pressing and joining the top web to the carrier web, thereby shortening the operating procedure. The stepwise conveying movement of the carrier web, and the continuous feed of the top web from a feed means, which takes place at the same time, permits the length of the forward feed steps and thus the width of the individual portions of a corrugated member to be varied as desired, in a procedure which is of optimum simplicity, while also ensuring at the same time that, without the need for special measures, the top web can be drawn out to provide the respective length required for the forward feed stepping movement and the configuration of the corrugated member.

The method according to the invention may be embodied in a particularly simple manner in that firstly both the deformation element and also a first pressing means which is disposed downstream of the deformation element in the feed direction are moved into their operative position in which the deformation element is disposed between the carrier web and the top web and wherein the first pressing means presses the top web against the carrier web, and that a second pressing means which is disposed upstream of the deformation element in the feed direction is then pressed against the top web in such a way that the top web is stretched or folded over the deformation element and pressed against the carrier web, and thereby joined to the carrier web in at least one respective portion of the pressing region of at least one of the pressing means.

That procedure ensures in particular that only the length of the forward feed steps of the carrier web have to be adjusted, in order to adjust and/or set a given configuration of the corrugated member, in dependence on the deformation element and/or the pressing means. Because of the manner in which the deformation process takes place, the top web is automatically adapted to the length of the forward feed stepping movements and the configuration of the deformation element and the pressing means, and can be drawn from a roll in a very simple manner. Desirably, the deformation element is first introduced between the top web and the carrier web and at the same time the first pressing means is pressed against the top web and the deformation element. That ensures fold-free deformation and in particular also permits the top web to be deformed, in accordance with the surface configuration of the deformation element and the pressing means.

The operating cycle of the method may be further shortened if each connecting location between the top web and the carrier web is engaged both by the first pressing means and by the second pressing means, and the top web and the backing web are joined during the pressing operation of the two pressing means. That permits for example the top web and the carrier web to be provisionally joined together in the region of the first pressing means, with the subsequent permanent connection being produced in the region of the second pressing means. As the operation of connecting the top web and the carrier web is a time consuming one, both when using adhesive or other drying or heat-hardening or other physically or chemically activatable joining agents, and also when using a welding process or similar procedures, the above-mentioned steps in the method permit the amount of time involved in the pressing and joining operations to be shortened in many cases. In addition, in accordance with the invention, the above-mentioned steps ensure that more time is available for the pressing and joining operation under the first pressing means, as the first pressing means is pressed against the top web, before the second pressing means.

In accordance with the invention, the top web and the carrier web may be joined together in a quite particularly advantageous manner, by using a heat-activatable agent for making the connection between the two webs, with the carrier web and/or the top web being heated in the region of the pressing means, during the pressing operation. Agents of this kind, such as for example thermoplastic adhesives and the like, may either be applied to the web during the forward feed movement of the carrier web and/or the top web, or may already be on at least one of the webs. In that case, it is only necessary to heat the assembly in the region of at least one pressing means, in order to join the top web and the carrier web together. If the assembly is heated in the region of both pressing means, then it will be seen that general heating of the adhesive and provisional joining of the two webs may be initially effected at the first pressing means, while complete plasticisation and permanent joining of the two webs is effected in the region of the second pressing means.

It will be appreciated however that the invention may also be embodied, using connecting agents which are applied in a hot condition, or agents which dry by means of heat. It is also possible to use connections formed by stamping or punching, other folding-type connections or form-locking or positive connections, and connections using mechanical connecting elements.

The present invention permits different corrugated configurations to be formed in a very simple manner, on one and the same corrugated member, if the length of a forward feed stepping movement of the carrier web is altered, relative to a preceding forward feed step. In that case, the upper portion or top web automatically adapts to the altered configuration.

Corrugated members with different corrugated configurations may also be produced by the surface configuration of the deformation element being altered, in at least one deformation step, relative to the shape used during a preceding deformation step. This may be achieved for example by using multi-part deformation elements, or by providing different deformation elements which can be alternately introduced between the top web and the carrier web.

If the top web is also to be deformed at the side against the deformation element or on the deformation element, that effect can be achieved in a particularly simple manner by the pressing means being pressed laterally against the deformation element and/or on to the deformation element. In this manner, virtually any surface configurations for the top web can be produced.

It is particularly advantageous for the top web to be provided, in the transverse direction relative to the corrugations, with corrugations or deformations of different heights and/or surface configurations. That permits the corrugated member to be used for packaging components of widely varying shapes.

The invention may be carried into effect in a particularly simple manner by means of an apparatus which is characterized in that there is provided a shaping station having a deformation table on which the carrier web can be transported forwards with a stepping motion in the longitudinal direction by means of a feed arrangement, that there is provided a feed or supply means for feeding the top web over the carrier web, that there is at least one deformation element which is arranged laterally and displaceably relative to the webs and the corrugations to be produced, in such a way that it can be introduced between the top web and the carrier web to shape a corrugation portion and, after the shaping operation, can be retracted again from the closed corrugation portion, that in addition there is provided, above the top web, a shaping means which has at least two pressing means and which can be pressed against the top web and the deformation table, and that there is also provided at least one drive and follower control means for cyclic advance of the feed arrangement and for cyclic displacement of the deformation element and the pressing means into the deformation position.

In the apparatus, the deformation elements which can be introduced from the side can be altered for producing different corrugated configurations, in a manner of the optimum simplicity. Because the shaping means, with the pressing means, is disposed above the deformation element, the operations of shaping the webs on or over the deformation element, and pressing together or joining the top web and the carrier web, may be performed at the same time. In this respect, the cyclic actuation of the pressing means, the web forward feed arrangement and the deformation element will not cause the man skilled in the art any difficulties. The follower control assembly may be of a mechanical or electronic and also hydraulic or pneumatic design, in per se known manner.

Adjustment of the shaping station may be effected in a particularly simple manner by the carrier web forward feed means comprising a drive means having an arrangement for the stepless adjustment of the forward feed movement of the forward feed means. In this manner, the forward feed movement of a feed step may be adapted to the configuration of the deformation element, as desired.

The invention can be carried into practical effect in a particularly simple manner, if the carrier web forward feed means has a holding means for retaining the carrier web during the forward feed motion. In this manner, the forward feed means may perform a simple stroke movement, with a forward and a rearward stop or rest position, wherein the holding means, for retaining and transporting the carrier web, is engaged therewith only during the forward feed motion, but is disengaged therefrom in the forward stop position, so that the rearward stroke movement is an idle stroke.

A particularly suitable arrangement for driving the forward feed means is coupling transmission means having at least two stop or rest positions, as are described for example by Guntram Merhar in Dissertation No. 6698 of the ETH (Eidgenossische Technische Hochschule, Zurich: The Federal Technical College of Zurich). The above mentioned positions may respectively delimit the forward stroke movement and the rearward stroke movement, and permit the top web to be deformed, and the top web and the carrier web to be connected together, at the shaping station.

Both adjustment of the stroke movement and also the provision of stop or rest positions in which the arrangement remains for a sufficient period of time may be achieved in a particularly advantageous manner by using a six-member coupling transmission means having two stop positions.

In accordance with the invention, control and adjustment of the forward feed means may be particularly fine in nature, by virtue of the drive means comprising a stepping motor drive with an adjustable number of pulses and/or an adjustable pulse length. Using a stepping motor has the great advantage that both the forward feed speed and also the forward feed stroke movement, and the duration of the stop positions, may be controlled virtually unlimitedly, by electronic means, in per se known manner.

Corrugated members of different configurations along the corrugations may be manufactured in a particularly simple manner if at least one of the pressing means is subdivided into at least two portions of different shapes and/or at least one of the pressing means is subdivided into two substantially juxtaposed pressing elements of different shapes, and if the deformation element is correspondingly subdivided in the same direction into at least two portions of different shapes. This structure permits the manufacture for example of corrugated members wherein the corrugations taper inwardly or outwardly, or portions which rise or fall in steps are subdivided. The possibility of adaptation to different corrugated configurations may be further improved in this connection if there are two deformation elements which can be inserted between the top web and the carrier web, from both sides. That arrangement also increases the speed of cyclic operation as in that case the deformation elements only have to be inserted by half the distance, from the two sides.

The invention may be carried into effect in a particularly simple and advantageous manner by using flat webs, that is to say, a carrier web and at least one top web, if at least one of the webs is provided, at least in portions thereof and at least in the surface region thereof, with an agent which can be activated by the application of heat, for joining the webs together. When using such a procedure, adhesive does not have to be applied in the region of the shaping station, and that increases the operating speed and reduces the liability to breakdown in the shaping station. In this respect, a particularly suitable agent for use in the method is a thermoplastic adhesive which can be applied to the carrier web for example in strips. However, it is quite particularly advantageous to use a thermoplastic coating which can be applied for example in the form of a protective layer on the carrier web and which at the same time forms the join between the carrier web and the top web, by virtue of its thermoplastic qualities. Particularly good qualities in respect of the material employed, while being extremely simple to use, are achieved if at least one web entirely comprises a thermoplastic material which softens when heat is applied thereto and which can be joined to the other web. In this way, the application of adhesive is no longer necessary and in addition suitable selection of material permits the manufacture of a corrugated member which is not sensitive to moisture and which is of a pleasant shape. It will be appreciated that the carrier web and/or the top web may also be cut to the length required for the finished corrugated member, before or after the deformation operation. It will be seen that the inventive content and the technical advance of the subject matter of this application are ensured not just by the individual novel and inventive features but in particular also by combining and sub-combining the features employed.

BRIEF DESCRIPTION OF THE DRAWINGS

The invention is described in greater detail hereinafter in embodiments, with reference to the accompanying drawings in which.

DESCRIPTION OF PREFERRED EMBODIMENTS

Figure 1:
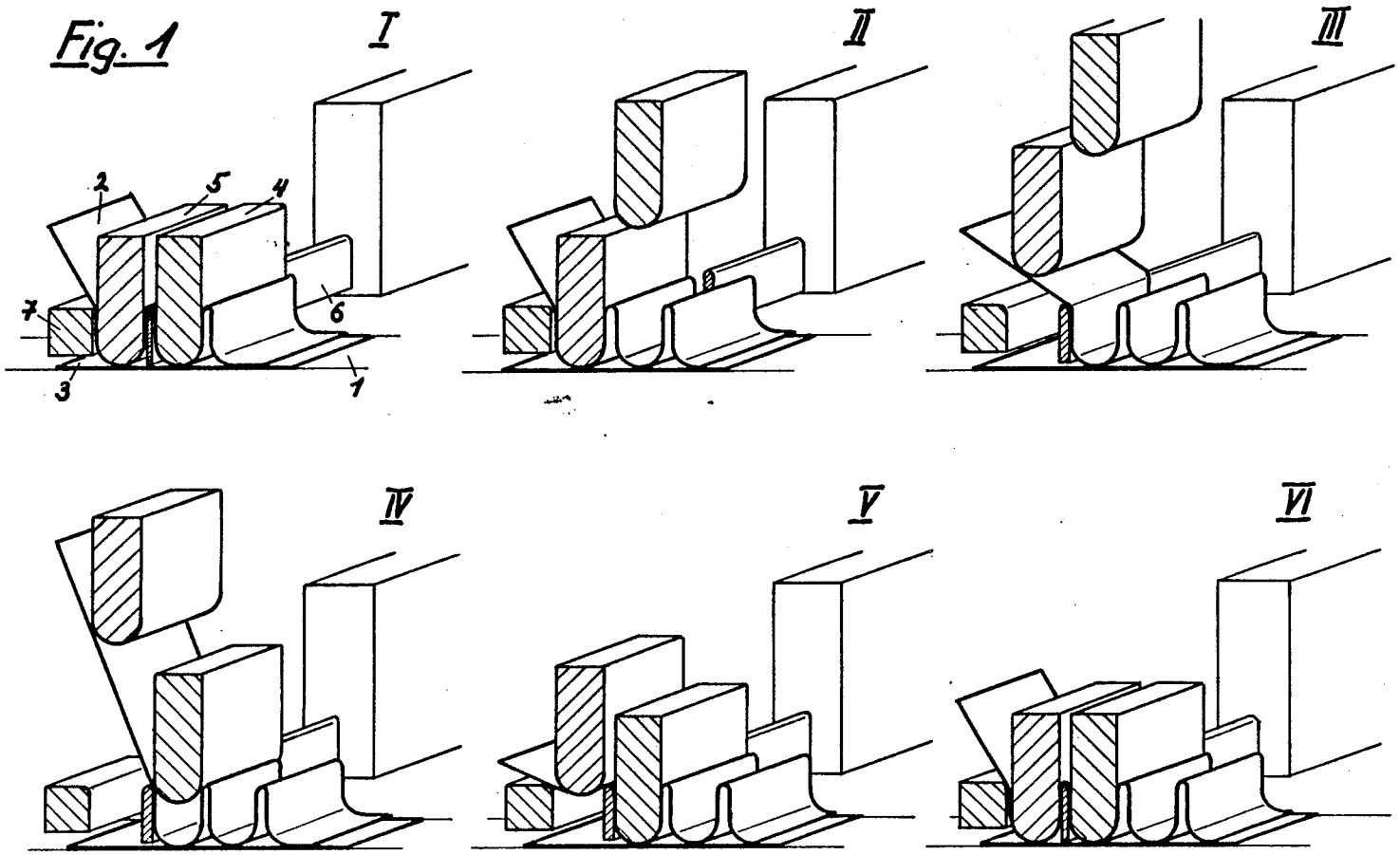
FIG. 1 diagrammatically shows the manner of performance of a method according to the invention.

Referring to FIG. 1, a top web 2 is connected to a carrier web 3 in a shaping station 1. The individual steps I to VI of the method take place in the following manner: during step I, a first pressing means 4 and a second pressing means 5 are in their operative positions, in which they press the top web 2 against the carrier web 3 and at the same time join the two webs together. An adhesive is applied to the carrier web 3 in a manner which may be considered as conventional and is not shown in the drawing, and joins the two webs together during the pressing operation. A defomation element is disposed in its operative position between the first pressing means 4 and the second pressing means 5, in such a manner that the top web 2 is extended in a corrugated configuration over the deformation element 6. A lateral punch member 7 presses against the top web 2 and the second pressing means 5 and thus causes the top web 2 to be cleanly folded over the deformation element 6.

Method step II shows the manner in which the first pressing means 4 first comes out of engagement with the top web 2, with the deformation element 6 then being laterally withdrawn from the closed corrugated portion.

Method step III shows the manner in which the punch member 7 is then also retracted, the second pressing means 5 is moved out of engagement with the top web 2 and at the same time the carrier web 3 is moved on by a further step, that is to say, towards the right in the drawing.

Method step IV shows the manner in which the deformation element 6 is then re-introduced between the carrier web 3 and the top web 2, and the first pressing means is then pressed into the corrugated portion in which the second pressing means 5 was disposed in the previous working step. This double use of a pressing means at the same connecting location ensures that on the one hand the top web 2 is firmly pressed and held against the carrier web 3 so that upon subsequent engagement of the second pressing means 5 during method steps V and VI the top web 2 can be held fast and stretched over the deformation element 6, without then breaking the connection which has already been formed between the top web 2 and the carrier web 3. In addition, the double pressing action improves the connection between the carrier web 3 and the top web 2.

Method step V shows the manner in which the top web 2 is stretched over the deformation element 6, and thus deformed.

Method step VI, similarly to method step I, shows the top web 2 and the carrier web 3 being pressed and joined by the second pressing means 5. It will be seen that, during the forward feed movement of the carrier web 3, the top web 2 is automatically drawn along, without the necessity for a special conveying action. In this connection, the top web 2 may be drawn from a roll in per se known manner, while, in order to avoid jerky tensile loads during the forward feed movement, the material may be guided in per se known manner in loops or over dancer rollers and the like.

Figure 2:
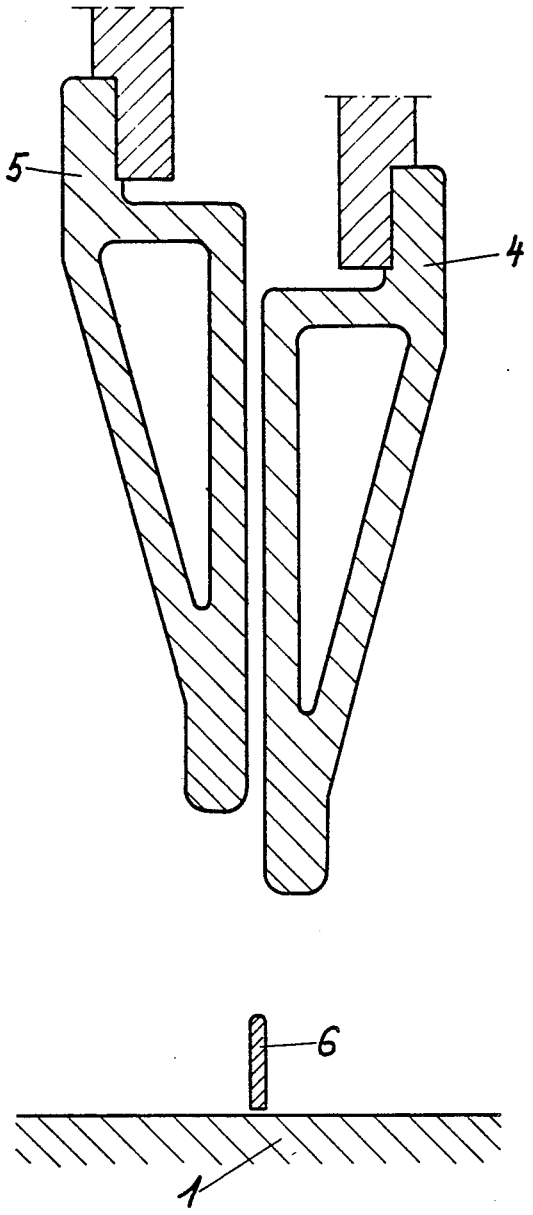
FIG. 2 is a diagrammatic view of the deformation element and the pressing means at a shaping station, having the features according to the invention.

FIG. 2 shows a view on an enlarged scale of the two pressing means 4 and 5. The lateral inclination or slant which can be seen in the drawing permits the top web 2 to be fed past the second pressing means 5, without being impeded.

Figure 3:
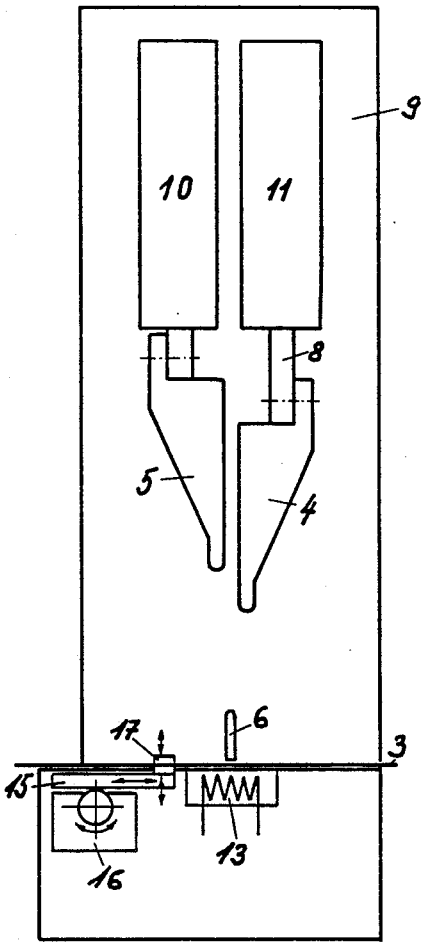
FIG. 3 shows a diagrammatic view of a shaping station, transversely with respect to the direction of the web.
Figure 4:
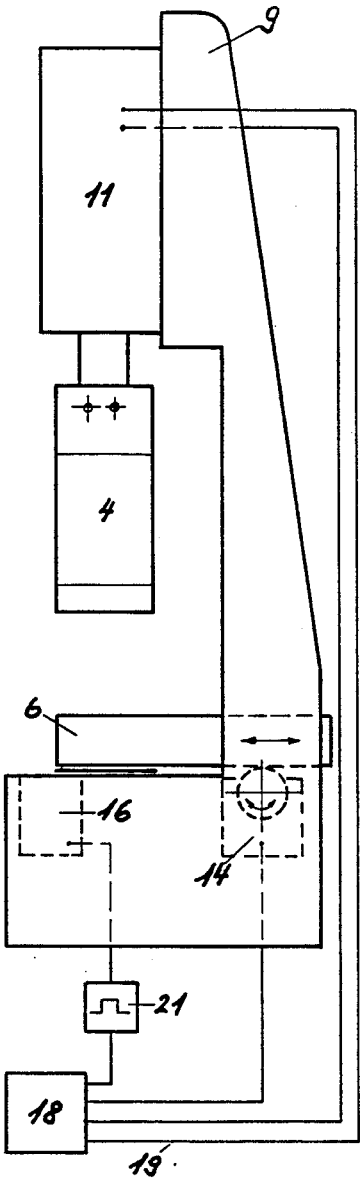
FIG. 4 shows the FIG. 3 shaping station viewing along the direction of the web.

Referring to FIGS. 3 and 4, the pressing means 4 and 5 are secured by means of thrust rods 8 to two hydraulic pressing assemblies 10 and 11 which in turn are carried on a frame structure 9. The shaping station 1 (see FIG. 1) is disposed vertically below the pressing means 4 and 5 and comprises a deformation table which is provided with a heating arrangement 13 in the region of the deformation element 6. A motor 14 (FIG. 4) is provided for lateral displacement of the deformation element 6.

In addition, the arrangement includes a forward feed means 15 having a drive means 16 and a gripper 17 at the shaping station, for moving the carrier web 3 forwardly with a stepping motion at the shaping station. For the purposes of actuating the drive means 16, the motor 14 and the pressing assemblies 10 and 11 at the rhythm of the method steps shown in FIG. 1, the arrangement has a follower control means 18 which produces the appropriate control commands in the sequence of the method steps shown in FIG. 1, by way of control lines 19. Such follower control apparatuses for actuating pressing assemblies, for example by way of suitable valves, or for actuating motors by way of suitable switching means, are generally known and do not require more detailed description herein.

Figure 5:
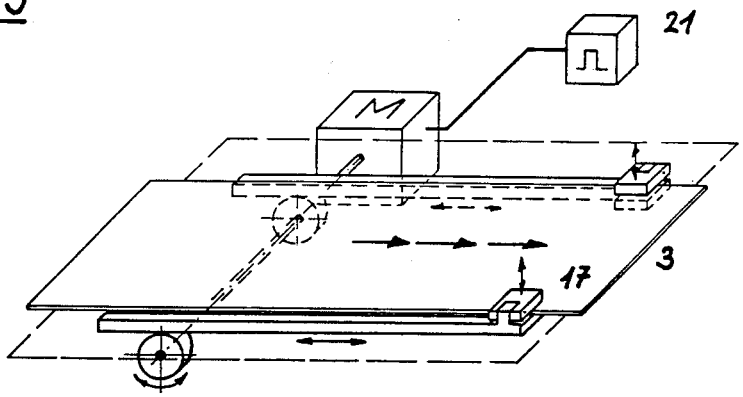
FIG. 5 shows a diagrammatic view of a forward feed arrangement as shown in FIG. 3, FIGS. 6 to 11 show different embodiments of pressing means and deformation elements, during the deformation and pressing operation.

The forward feed means is driven by means of a stepping motor drive comprising a pulse generator 21 and a stepping motor M (FIG. 5). The duration and frequency of the pulses produced by the pulse generator 21 are adjustable in per se known manner so as to permit adjustment both of the speed of the stroke movement and also the length of the stroke movement, during a forward stepping motion of the gripper members 17. By virtue of this arrangement, the forward feed movement of the carrier web 3 may be adjusted and adapted as desired, depending on the shape and configuration of the corrugated member to be manufactured. As shown in diagrammatic form in FIG. 5, the gripper members 17 are pivoted against the carrier web 3 during the forward feed stroke movement so that they grip the carrier web 3 and move it in a forward direction. On the other hand, in the rearward stroke movement, the gripper members 17 are moved away from the carrier web 3 so that they are retracted in an idle condition, during the rearward stroke movement. The gripper members 17 are pivoted by a magnet assembly (not shown). Accordingly, during the rearward stroke movement, the carrier web 3 remains in the feed position that it last achieved, whereupon the procedure shown in FIG. 1 is carried out.

Figure 6:
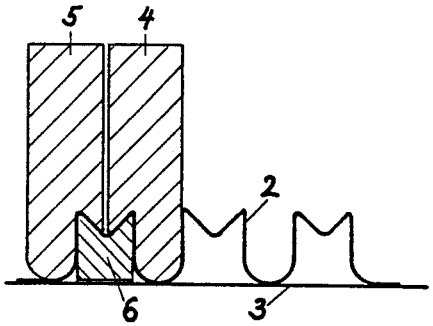

FIG. 6 shows two pressing means 4 and 5 and a deformation element 6 for manufacturing a corrugated member of a modified configuration. It will be seen that in this case the top web 2 is not only stretched over the deformation element 6 but is also pressed thereagainst by the pressing means 4 and 5. This permits the illustrated configuration to be produced without difficulty.

Figure 7:
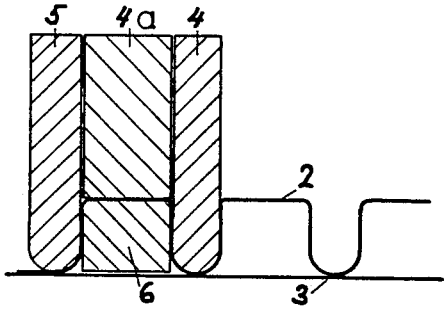

FIG. 7 shows an arrangement comprising three pressing means 4, **4*a* and 5. In carrying out the method, the first pressing means 4 is first moved into its position of engagement. That is then followed by the additional pressing means 4*a* which presses the top web 2 against the element 6. This produces the desired formation of edges as shown and at the same time avoids the top web raising folds, as could be the case if the second pressing means 5 were lowered before the additional pressing means 4*a*. In other respects, the deformation operation with the embodiment shown in FIG. 7 takes place in a similar manner to that shown in FIG. 1**.

Figure 8:
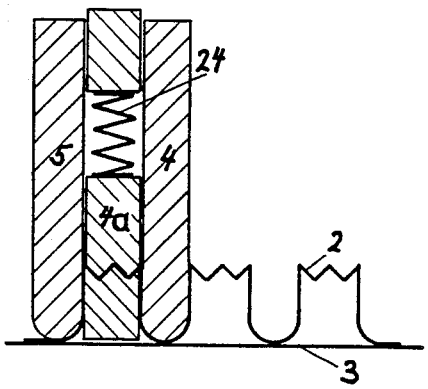

FIG. 8 shows a modified embodiment wherein the additional pressing means **4*a* is mechanically connected to the pressing means 5. In spite of this, the procedure involved in the embodiment shown in FIG. 8 is the same as in the embodiment shown in FIG. 7. In other words, the first pressing means 4 first comes into engagement, followed then by downward movement of the additional pressing means 4*a* to press against the top web 2 or the element 6, and only then does the second pressing means 5 move into its position of engagement. This is achieved by the additional pressing means 4*a* being longitudinally displaceably mounted on the second pressing means 5 and being urged by a spring 24 into a downward position so that the additional pressing means 4*a* first presses, in the above-mentioned downward position, against the top web 2 and the element 6, then being displaced relative to the second pressing means 5 against the force of the spring 24, during the further downward movement of the second pressing means 5**.

Figure 9:
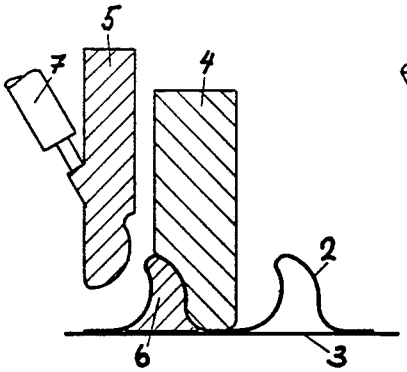

FIG. 9 shows a modified embodiment wherein the element 6 is provided with a lateral depression in order to impart a corresponding configuration to the corrugated member produced. In the course of the deformation operation, the first pressing means 4 is first pressed against the top web 2 and the element 6. The second pressing means 5 is then lowered and displaced laterally by the punch member 7, and thus pressed into the depression 25 in the deformation element 6. It will be seen that the illustrated arrangement permits any surface configurations on the side of the corrugations of the corrugated member to be produced in a very simple manner.

Figure 10:
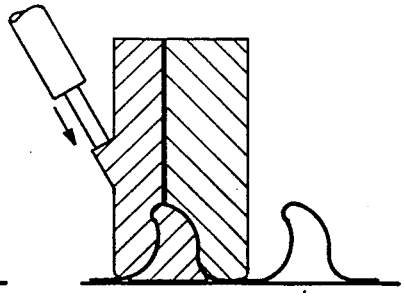
Figure 11:
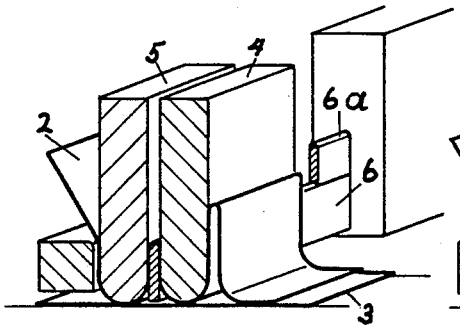

The embodiment shown in FIGS. 10 and 11 is used to manufacture a corrugated member with corrugated portions of different heights. For that purpose, the element 6 is subdivided and has an upper portion **6*a*. FIG. 10 shows a pressing operation in which only the lower portion of the element 6 is in an engagement position and accordingly the corrugated portion of the corrugated member formed is lower. On the other hand, in the deformation step shown in FIG. 11**, the upper portion 6a of the element 6 is also introduced between the top web 2 and the carrier web 3 so as to produce a higher corrugated configuration. It will be appreciated that, by suitable design in respect of the follower control means 18 (FIG. 4), the deformation element 6 can be engaged between the two webs, with or without its upper portion 6a, in any desired sequence.

Figure 12:
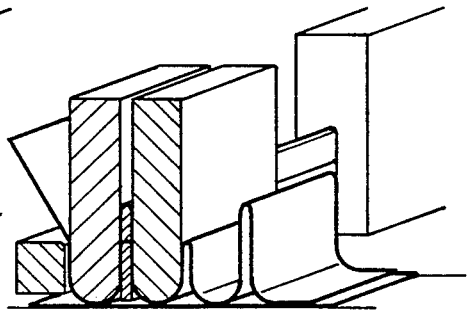
FIG. 12 shows a diagrammatic view of a shaping station with a heating arrangement.

FIG. 12 shows a carrier web 3 which is provided with two strips 26 of a thermoplastic adhesive. The carrier web 3 is heated in the region of the heating arrangement 13 which is in the form of an electrical resistance heating means so as to soften and activate the strips of adhesive 26. In this manner, the carrier web and the top web can be joined together by simply being pressed by means of the pressing means 4 and 5. In this connection, it is particularly advantageous that the heating arrangement 13 is disposed in the region of the two pressing means 4 and 5 so that the carrier web 3 can be heated in the region of the second pressing means for a relatively short period of time which is sufficient provisionally to join together the top web 2 and the carrier web 3. When then the carrier web 3, which is still in a hot condition, is moved forward in the subsequent method step (see FIG. 1) in such a way that the corrugated portion which is under the second pressing means 5 during the first step moves into a position under the first pressing means 4, the connecting location between the top web 2 and the carrier web 3, which is still in a hot condition, is compressed again, thereby ensuring a permanent connection between the two webs.

Figure 13:
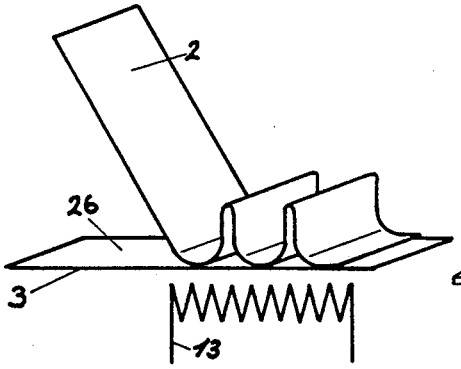
FIG. 13 shows a view on an enlarged scale of a carrier web coated with thermoplastic material, in conjunction with a top web.
Figure 13:
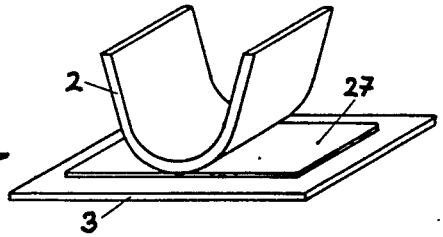

FIG. 13 shows a carrier web 3 which is provided with a continuous coating 27 of thermoplastic material. The coating 27 serves on the one hand to protect the surface of the carrier web 3 so that it is insensitive to water and moisture. At the same time however, the coating 27 is softened in the region of the point at which it is connected to the top web 2, by being heated by means of the heating arrangement 13, and a permanent connection between the two webs can be formed by the pressing action applied by the pressing means 4 and 5.

Figure 14:
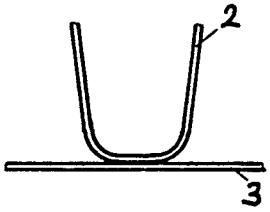
FIG. 14 shows a view on an enlarged scale of a top web comprising thermoplastic material, in conjunction with a carrier web.

FIG. 14 shows an embodiment wherein the top web 2 completely comprises thermoplastic material. In this case also the connection between the top web 2 and the carrier web 3 is produced by softening in the region of the heating arrangement 13 or the pressing means 4 and 5.

This represents a particularly simple and advantageous design in respect of a corrugated member. On the one hand, there is no need to apply adhesive strips 26 and on the other hand the top web 2 is absolutely insensitive to water, which may be desirable in certain situations of use.

Figure 15:
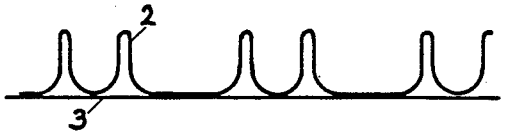
FIG. 15 shows a side view of a corrugated member manufactured with different forward feed stepping movements.

FIG. 15 shows an embodiment of a corrugated member wherein the forward feed stepping movements in respect of successive portions of the corrugated member are increased in a ratio of 1:2, by suitable actuation of the forward feed means 15. The corrugated member can thereby be adapted to the requirements of the articles to be packaged, in a manner of the optimum simplicity.

Figure 16:
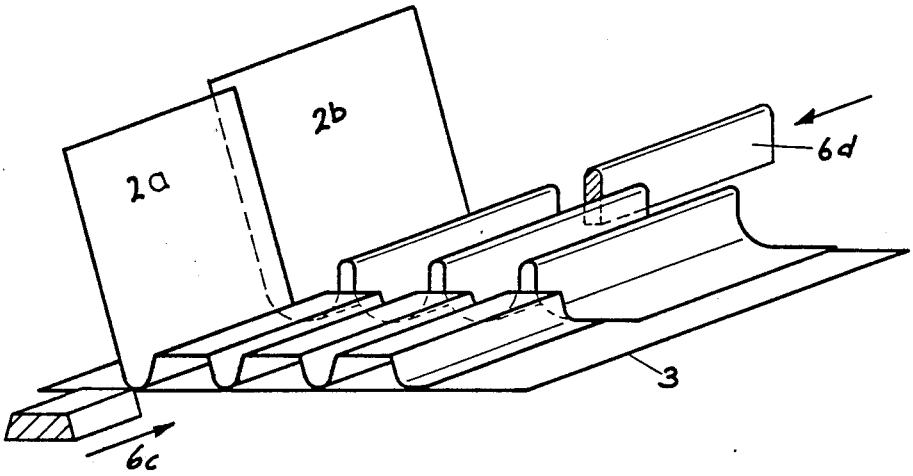
FIG. 16 shows a diagrammatic view of the method of manufacturing a corrugated member with two different top webs.

FIG. 16 shows an embodiment wherein two top webs 2a and 2b are disposed on a carrier web 3. The configuration formed by the top web 2a corresponds generally to the embodiment shown in FIG. 6 and the deformation element 6c and a first pair of pressing means 4 and 5 (not shown) are constructed as illustrated therein. In contrast, the configuration formed by the top web 2b corresponds to the structure shown in FIG. 1 and the deformation element 6d and a second pair of pressing means 4, 5 (not shown) are of a corresponding construction. In other words, to manufacture the corrugated member shown in FIG. 16, the arrangement has two deformation elements 6c and 6d which can be inserted from respective opposite sides, and also two juxtaposed pairs of pressing means 4 and 5, for carrying out the deformation operation. Corrugated members of the form illustrated, that is to say, with two different surface configurations, may obviously also be produced by using a suitable configuration in respect of the deformation elements 6 and the pressing means 4, 5, in such a way that a continuous top web 2 can be used. That entirely depends on the configuration desired.

I claim:

1. In an apparatus for manufacturing a corrugated member having a carrier web with a top web arranged thereon in a corrugated configuration, wherein the top web is joined to the carrier web in the region of the respective depressions which extend transversely with respect to the direction of the web, said apparatus comprising a shaping station having a deformation table on which the carrier web can be transported forward with a stepping motion in the longitudinal direction by means of a feed arrangement, feed means for feeding the top web over the carrier web, shaping means above the top web, which shaping means has at least two pressing means that can be pressed against the top web and the deformation table, and at least one drive and control means for cyclic advance of the feed arrangement and for cyclic displacement of the pressing means into the deformation position, wherein the improvement comprises;

a deformation element at the shaping station arranged laterally and displaceable relative to the corrugations to be produced and cyclically displaceable by said drive and control means such that it can be laterally inserted between the top web and the carrier web to shape a corrugation portion and, after the shaping operation, can be laterally retracted again from the closed corrugation portion;

said at least two pressing means include a first pressing means arranged downstream of the deformation element and a second pressing means arranged upstream of the deformation element relative to the feed direction, and wherein the first and second pressing means can by actuated independently of one another; and said drive and control means comprise means for first laterally inserting said deformation element, then pressing said first pressing means against the top web, then pressing said second pressing means against said top web, then raising said first pressing means and laterally withdrawing said deformation element, and then raising said second pressing means, advancing the carrier web in its stepping motion, and repeat the cycle.

2. An apparatus according to claim 1, wherein:

said drive and control means is operative to manipulate said first and second pressing means such that each connecting location between the top web and the carrier web is engaged both by the first pressing means and subsequently by the second pressing means, and the top web and the backing web are joined during the pressing operation of the two pressing means.

3. Apparatus according to claim 1 characterized in that there are at least two deformation elements which can be individually or jointly inserted between the top and the carrier web, for the deformation operation.

4. Apparatus according to claim 1 characterized in that the carrier web forward feed means comprises a drive means having an arrangement for adjusting the feed travel of the forward feed means.

5. Apparatus according to claim 4 characterized in that the carrier web forward feed means has a holding means for retaining the carrier web during the forward feed movement.

6. Apparatus according to claim 5 characterized in that the drive means has a coupling transmission means having at least two stop locations which respectively delimit the forward stroke movement and the rearward stroke movement, and that the holding means is actuable in such a way that it engages with the carrier web for holding and conveying the carrier web during the forward stroke movement, and is out of engagement with the carrier web during the rearward movement.

7. Apparatus according to claim 6 characterized in that the stroke movement of the coupling transmission means is adjustable.

8. Apparatus according to claim 4 characterized in that the drive means comprises a stepping motor drive with an adjustable number of pulses and/or an adjustable pulse length.

9. Apparatus according to claim 1 characterized in that at least one of the pressing means and the deformation table is provided with a heating arrangement.

10. Apparatus according to claim 1 characterized in that at least one of the pressing means is provided with an assembly for pressing against the side of the deformation element.

11. Apparatus according to claim 10 characterized in that a pressing punch is provided for laterally displacing and pressing the pressing means against the deformation element.

12. Apparatus according to claim 1 characterized in that at least one of the pressing means is subdivided into at least two portions of different shapes, to produce corrugated members with a different surface configuration in the transverse direction relative to web travel, and that the deformation element is also divided into at least two portions in the transverse direction.

13. Apparatus according to claim 1 characterized in that there are two deformation elements which can be inserted between the top web and the carrier web, from both sides.

* * * * *